US006975277B2

(12) United States Patent
Tran

(10) Patent No.: US 6,975,277 B2
(45) Date of Patent: Dec. 13, 2005

(54) WIRELESS COMMUNICATIONS DEVICE PSEUDO-FRACTAL ANTENNA

(75) Inventor: Allen Tran, San Diego, CA (US)

(73) Assignee: Kyocera Wireless Corp., San Diego, CA (US)

( * ) Notice: Subject to any disclaimer, the term of this patent is extended or adjusted under 35 U.S.C. 154(b) by 31 days.

(21) Appl. No.: 10/718,830

(22) Filed: Nov. 21, 2003

(65) Prior Publication Data

US 2005/0110682 A1 May 26, 2005

(51) Int. Cl.[7] ..... H01Q 11/10; H01Q 9/16
(52) U.S. Cl. ..... 343/792.5; 343/793; 343/895
(58) Field of Search ..... 343/792.5, 793, 343/893, 895, 700 MS, 702, 829, 846, 909

(56) References Cited

U.S. PATENT DOCUMENTS 6,140,975 A * 10/2000 Cohen ..... 343/846
6,278,340 B1 * 8/2001 Liu ..... 333/26
6,445,352 B1 * 9/2002 Cohen ..... 343/745
6,452,553 B1 * 9/2002 Cohen ..... 343/702
6,476,766 B1 * 11/2002 Cohen ..... 343/700 MS
2003/0034918 A1 * 2/2003 Werner et al. ..... 343/700 MS
2004/0164904 A1 * 8/2004 Tran ..... 343/700 MS
2005/0007294 A1 * 1/2005 Handelsman ..... 343/867

* cited by examiner

*Primary Examiner*—Trinh Vo Dinh

(57) ABSTRACT

A pseudo-fractal antenna is provided comprising a dielectric, and a radiator proximate to the dielectric having an effective electrical length formed in a pseudo-fractal geometry. That is, the radiator includes at least one section formed in a fractal geometry and at least one section formed in a non-fractal geometry. The antenna can be either a monopole or a dipole antenna. For use in a wireless communication telephone, the antenna operating frequency can be approximately 1575 megahertz (MHz), to receive global positioning satellite (GPS) information. In one aspect, the radiator has a fractal geometry section formed as a Koch curve. When the antenna is a dipole, the counterpoise can also be a pseudo-fractal geometry with a section formed in Koch curve fractal geometry section. The radiator can be a conductor embedded in the dielectric. Alternately, the radiator is a conductive line overlying a dielectric layer.

52 Claims, 4 Drawing Sheets

WIRELESS COMMUNICATIONS DEVICE PSEUDO-FRACTAL ANTENNA

BACKGROUND OF THE INVENTION

1. Field of the Invention

This invention generally relates to wireless communication antennas and, more particularly, to a pseudo-fractal antenna system and method using elements of fractal geometry.

2. Description of the Related Art

As noted in U.S. Pat. No. 6,140,975 (Cohen), antenna design has historically been dominated by Euclidean geometry. In such designs, the closed antenna area is directly proportional to the antenna perimeter. For example, if one doubles the length of an Euclidean square (or "quad") antenna, the enclosed area of the antenna quadruples. Classical antenna design has dealt with planes, circles, triangles, squares, ellipses, rectangles, hemispheres, paraboloids, and the like, (as well as lines). Similarly, resonators, typically capacitors coupled in series and/or parallel with inductors, traditionally are implemented with Euclidian inductors. The prior art design philosophy has been to pick a Euclidean geometric construction, e.g., a quad, and to explore its radiation characteristics, especially with emphasis on frequency resonance and power patterns. The unfortunate result is that antenna design has far too long concentrated on the ease of antenna construction, rather than on the underlying electro-magnetics.

One non-Euclidian geometry is fractal geometry. Fractal geometry may be grouped into random fractals, which are also termed chaotic or Brownian fractals and include a random noise components, or deterministic fractals. In deterministic fractal geometry, a self-similar structure results from the repetition of a design or motif (or "generator"), on a series of different size scales.

Experimentation with non-Euclidean structures has been undertaken with respect to electromagnetic waves, including radio antennas. Prior art spiral antennas, cone antennas, and V-shaped antennas may be considered as a continuous, deterministic first order fractal, whose motif continuously expands as distance increases from a central point. A log-periodic antenna may be considered a type of continuous fractal in that it is fabricated from a radially expanding structure. However, log periodic antennas do not utilize the antenna perimeter for radiation, but instead rely upon an arc-like opening angle in the antenna geometry.

Unintentionally, first order fractals have been used to distort the shape of dipole and vertical antennas to increase gain, the shapes being defined as a Brownian-type of chaotic fractals. First order fractals have also been used to reduce horn-type antenna geometry, in which a double-ridge horn configuration is used to decrease resonant frequency. The use of rectangular, box-like, and triangular shapes as impedance-matching loading elements to shorten antenna element dimensions is also known in the art.

Whether intentional or not, such prior art attempts to use a quasi-fractal or fractal motif in an antenna employ at best a first order iteration fractal. By first iteration it is meant that one Euclidian structure is loaded with another Euclidean structure in a repetitive fashion, using the same size for repetition.

Antenna designed with fractal generators and a number of iterations, which is referred to herein as fractal geometry, appear to offer performance advantages over the conventional Euclidian antenna designs. Alternately, even if performance is not improved, the fractal designs permit antennas to be designed in a new form factor. However, the form factor of a fractal antenna need not necessarily be smaller than a comparable Euclidian antenna, and it need not fit within the constraints of a portable wireless communication device package.

It would be advantageous if fractal geometry could be used in the design of antennas, to fit the antenna form factor within predetermined package constraints.

It would be advantageous if parts of an antenna's radiator could be shaped using fractal geometry, but other parts of the radiator shaped using non-fractal geometry to fit predetermined package constraints.

SUMMARY OF THE INVENTION

The present invention pseudo-fractal antenna incorporates elements of fractal geometry and Euclidian geometry. The patterns generated through the use of fractal geometry can generally be used to reduce the overall form factor of an antenna. However, due to the extreme space constraints in a wireless communication device, such as a telephone, even fractal geometry antennas are difficult to fit. Therefore, the present invention pseudo-fractal antenna forms a radiator using fractal sections, and non-fractal geometry sections for efficiently fitting the antenna within the assigned space.

Accordingly, a pseudo-fractal antenna is provided comprising a dielectric, and a radiator proximate to the dielectric having an effective electrical length formed in a pseudo-fractal geometry. That is, the radiator includes at least one section formed in a fractal geometry and at least one section formed in a non-fractal geometry.

The antenna can be either a monopole or a dipole antenna. For use in a wireless communication telephone, the antenna operating frequency can be approximately 1575 megahertz (MHz), to receive global positioning satellite (GPS) information, approximately 850 MHz to transceive cellular band telephone communications, or approximately 1920 MHz to transceive PCS band telephone communications.

Typically, the radiator has a fractal geometry section formed as a Koch curve. When the antenna is a dipole, the counterpoise can also be a pseudo-fractal geometry with a section formed in Koch curve fractal geometry section. In some aspects, the radiator is a conductor embedded in the dielectric. Alternately, the dielectric is a dielectric layer, and the radiator is a conductive line overlying the dielectric layer.

Additional details of the above-described pseudo-fractal antenna, and a method for forming a pseudo-fractal antenna are described below.

DETAILED DESCRIPTION OF THE PREFERRED EMBODIMENTS

Figure 2A:
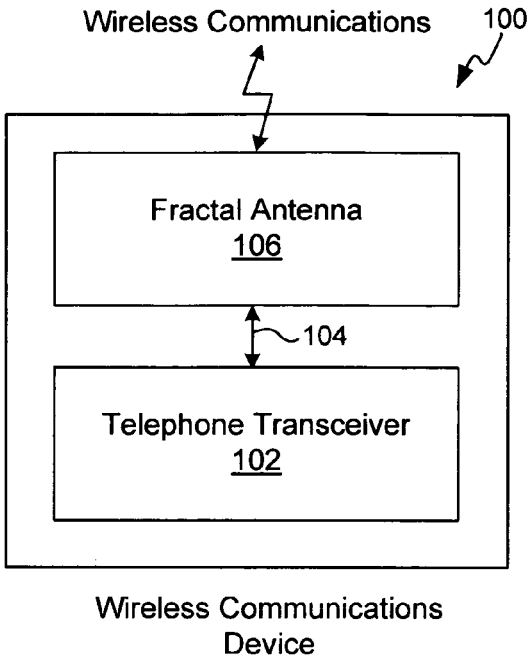
FIG. 2*a* is a schematic block diagram of the present invention wireless communications system.

FIG. 2*a* is a schematic block diagram of the present invention wireless communications system. The system 100 comprises a wireless telephone transceiver 102 having a communications port on line 104, connected to a fractal antenna 106.

Figure 2C:
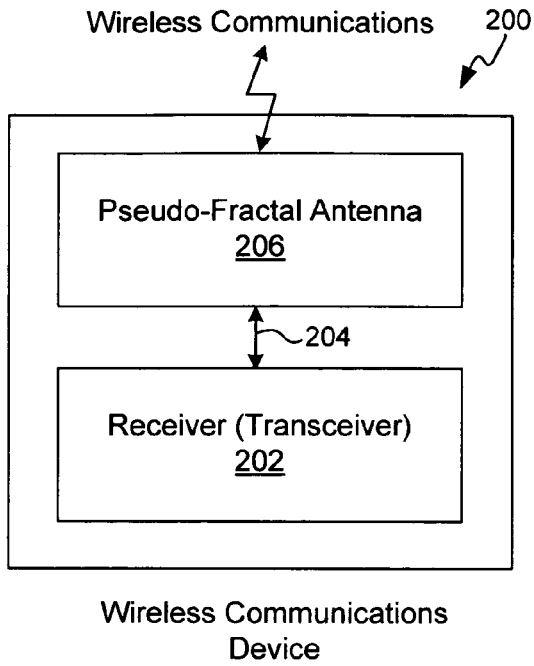
FIG. 2*c* is a schematic block diagram of the present invention wireless communications device system, using a pseudo-fractal antenna.
Figure 2B:
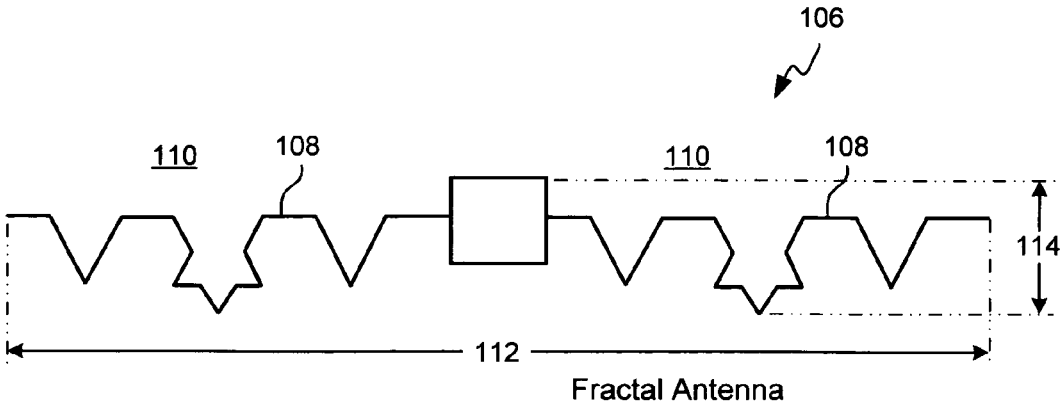
FIG. 2*b* is plan view of the fractal antenna of FIG. 2*a*.

FIG. 2*b* is plan view of the fractal antenna 106 of FIG. 2*a*. The fractal antenna 106 has a radiator 108, proximate to a dielectric 110, with an effective electrical length formed in a fractal geometry. As shown, the fractal geometry is a second order iteration of a Koch curve. However, the present invention is not limited to any particular order of iteration or curve. For example, the curve can also be Minkowski, Julia, Cantor, torn square, Mandelbrot, Caley tree, monkey's swing, or Sierpinski gasket. Although the antenna 106 has an overall length 112 that is less than a conventional straight line dipole, it may still not fit within the constraints of the system chassis. For example, the length 112 may still be too long, or the overall width 114 may exceed the constraints. The generation of additional iterations would not significantly reduce the overall length 112, but it would significantly increase the complexity of the shape, making the antenna 106 more difficult to manufacture.

FIG. 2*c* is a schematic block diagram of the present invention wireless communications device system 200, using a pseudo-fractal antenna. The system 200 comprises a wireless communication device receiver (or transceiver) 202 having a communications port on line 204 connected to a pseudo-fractal antenna 206.

Figure 1:
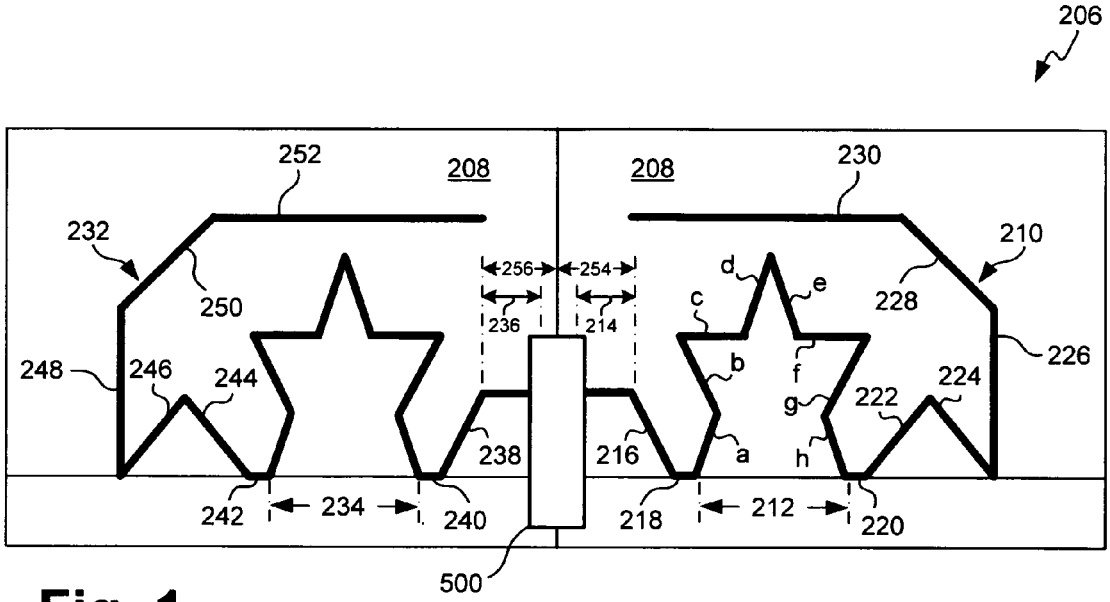
FIG. 1 is a plan view of the pseudo-fractal antenna of FIG. 2*c*.

FIG. 1 is a plan view of the pseudo-fractal antenna 206 of FIG. 2*c*. The pseudo-fractal antenna 206 includes a dielectric 208 and a radiator 210 proximate to the dielectric 208 having an effective electrical length formed in a pseudo-fractal geometry. As defined herein, a pseudo-fractal geometry means that the radiator 210 includes at least one section 212 formed in a fractal geometry. Likewise, it means that the radiator 210 includes at least one section formed in a non-fractal geometry. As shown, sections 214–230 are formed in a non-fractal geometry.

As is well known in the art, a typical radiator 210 would have an effective electrical length of either a half-wavelength or a quarter-wavelength of the antenna operating frequency, depending upon the design and the antenna type. The antenna 206 can either be a dipole antenna as shown, or a monopole antenna, see FIG. 4.

When configured as a dipole, the antenna 206 further includes a counterpoise 232 having an effective electrical length. In one aspect of the invention, the counterpoise 232 has an effective electrical length formed in a pseudo-fractal geometry. That is, the counterpoise 232 includes at least one section 234 formed in a fractal geometry. The counterpoise likewise has an effective electrical length formed in a non-fractal geometry, sections 236–252.

As shown, the radiator fractal geometry section 212 and the counterpoise fractal geometry section 234 are formed in a Koch curve. More specifically, a second order iteration of the Koch curve is shown. However, the present invention antenna is not limited to any particular generator (other generators or curves are listed above in the description of FIG. 2*b*), or number of iterations.

In some aspects, the radiator 210 (and counterpoise 232) is a conductor embedded in the dielectric 208. A large variety of conventional dielectric materials can be used for this purpose, even air. Alternately as shown, the dielectric 208 is a dielectric layer and the radiator 210 (and counterpoise 232) is a conductive line overlying the dielectric layer.

In one aspect of the antenna, the conductive lines are approximately 30 mil width half-ounce copper formed over an approximately 15 mil thick layer of FR4 material. Then, the approximate lengths of the non-fractal sections are as listed below:

reference designator 214 (236)—0.094 inches
reference designator 216 (238)—0.180 inches
reference designator 218 (240)—0.045 inches
reference designator 220 (242)—0.045 inches
reference designator 222 (244)—0.180 inches
reference designator 224 (246)—0.180 inches
reference designator 226 (248)—0.232 inches
reference designator 228 (250)—0.475 inches
reference designator 254 (256)—0.140 inches Each of the subsections a through h of fractal geometry sections 212 and 234 has an approximate length of 0.120 inches. The antenna operates at a frequency of approximately 1575 megahertz (MHz). The radiator 210 and counterpoise 232 each have an effective electrical length of a quarter-wavelength of the antenna operating frequency.

Figure 3:
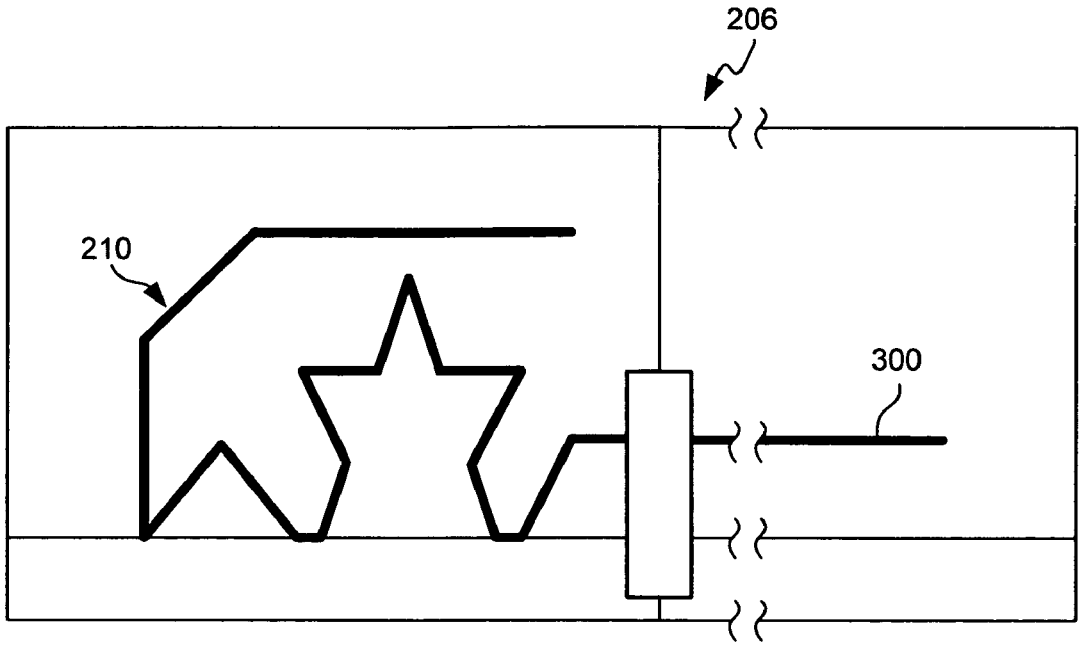
FIG. 3 depicts a variation of the pseudo-fractal antenna of FIG. 1.

FIG. 3 depicts a variation of the pseudo-fractal antenna 206 of FIG. 1. As shown, the antenna 206 has a pseudo-fractal geometry radiator 210, as described above, and a "straight-line" conventional counterpoise section 300. Note that the counterpoise 300 has been truncated to fit on the page. The counterpoise 300 could also be formed with non-fractal bends for space conservation. As above, the radiator 210 and counterpoise 300 can be embedded in a dielectric or printed on a dielectric layer. In some aspects, the radiator 210 is printed on a dielectric and a whip counterpoise is embedded in the medium of air.

Figure 4:
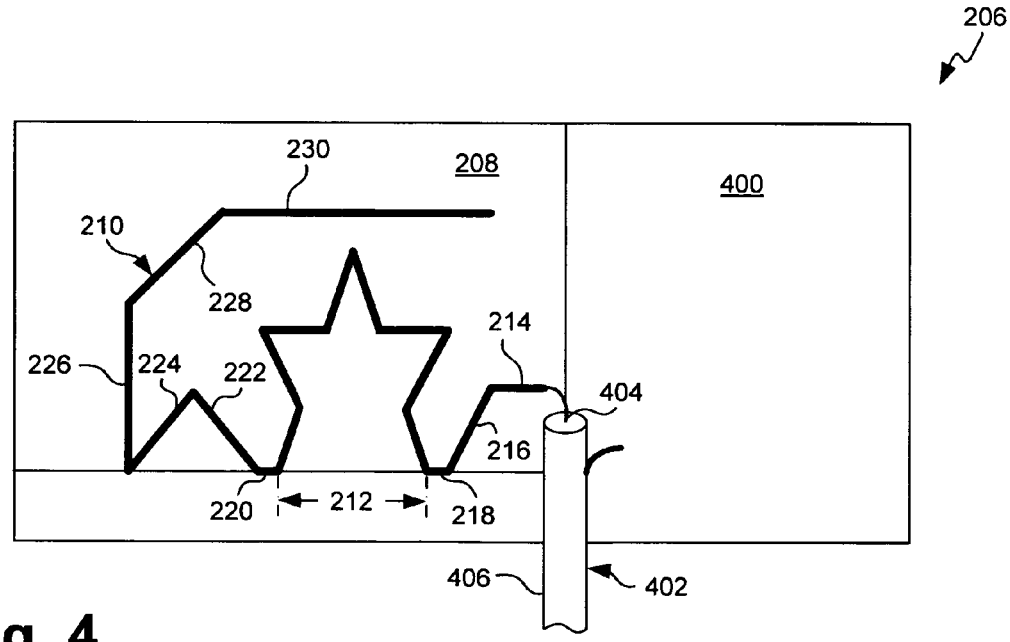
FIG. 4 is a monopole version of the pseudo-fractal antenna of FIG. 2*c*.

FIG. 4 is a monopole version of the pseudo-fractal antenna 206 of FIG. 2*c*. As above, the antenna 206 includes radiator 210 with at least one section 212 formed in a fractal geometry. Likewise, it means that the radiator 210 includes at least one section formed in a non-fractal geometry. As shown, sections 214–230 are formed in a non-fractal geometry. The antenna 206 also includes a counterpoise in the form of a groundplane 400. The dielectric 208 is interposed between the counterpoise 400 and the radiator 210.

The description of the radiator 210 is the same as the radiator of FIG. 1 and will not be repeated in the interest of brevity. As above, the radiator fractal geometry section 212 is shown formed in a Koch curve. Also as above, the radiator 210 can be a conductor embedded in the dielectric 208. Alternately, the dielectric 208 is a dielectric layer and the radiator 210 is a conductive line overlying the dielectric layer. The groundplane 400 can be a conductive area of chassis or circuit board proximate to the radiator 210.

The antenna 206 of FIG. 1 has a transmission line interface, and in some aspects of the system, the wireless communications device receiver 202 is a GPS receiver having a port connected to antenna transmission line interface on line 204. Therefore, the antenna 206 has operating frequency of approximately 1575 megahertz (MHz), to receive GPS signals. Alternately, the wireless communications device receiver 202 can be a telephone transceiver and the antenna 206 can operate at a frequency of approximately 850 or 1920 MHz. In some aspects, the receiver 202 can be a Bluetooth transceiver and the antenna 206 can operate at a frequency of approximately 2400 MHz.

As shown in FIG. 4 with a monopole antenna, in some aspects the transmission line interface is a simple connection to a coax cable 402, where the center conductor 404 is connected to the radiator 210 and the shield 406 is connected to ground 400. Alternately, the antenna can be connected to a microstrip or stripline transmission line (not shown). In some aspects as shown, at least one radiator non-fractal geometry section is formed further from the transmission line interface than the fractal geometry section 212. The concept of further as used in this context refers to the distance along the conductor. For example, section 250 is further from the feed than fractal geometry section 212 because it is further down the conductor than fractal section 212. Likewise in some aspects, at least one radiator non-fractal geometry section is formed closer to the transmission line interface than the fractal geometry section 212, section 214 for example. Closer means that the non-fractal section is less far down the conductor from the transmission line interface.

Figure 5:
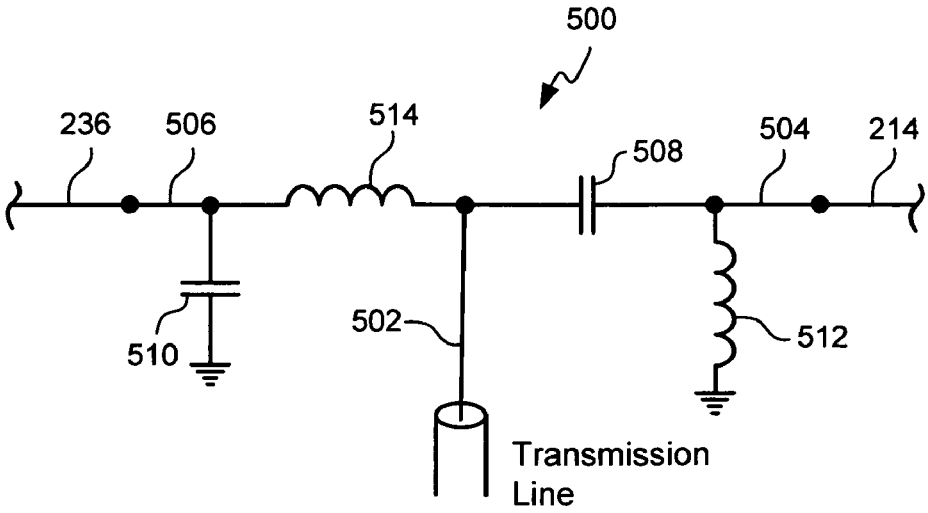
FIG. 5 is a drawing depicting in detail a transmission line interface suitable for use with a dipole antenna.

FIG. 5 is a drawing depicting in detail a transmission line interface suitable for use with a dipole antenna. A balun antenna feed 500 has a transmission line interface 502, a lead port 504 connected to the radiator (section 214), and a lag port 506, 180 degrees out of phase at the antenna operating frequency with the lead port 504, connected to the counterpoise (section 236). Lumped element capacitors 508 and 510 are shown, along with inductors 512 and 514. However, the capacitive or inductive characteristics may also be enabled, either completely or partially, with microstrip or stripline elements.

Returning momentarily to FIG. 1, in some aspects as shown, at least one radiator (or counterpoise) non-fractal geometry section is formed further from the transmission line interface than the fractal geometry section 212 (234) section 230 (252) for example. Likewise in some aspects, at least one radiator non-fractal geometry section is formed closer to the transmission line interface than the fractal geometry section 212 (234), section 214 (236) for example.

Figure 6:
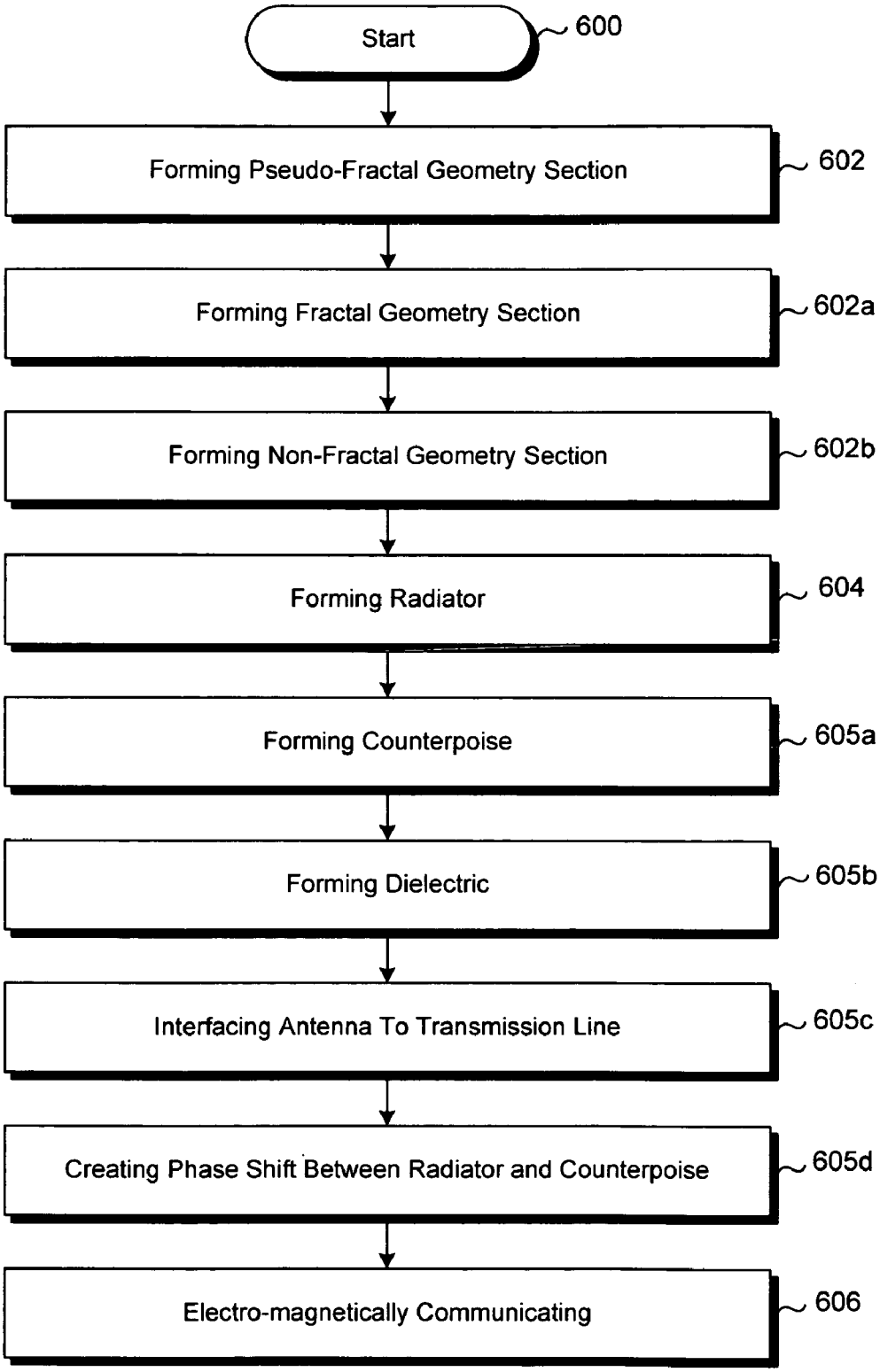
FIG. 6 is a flowchart illustrating the present invention method for forming a pseudo-fractal antenna.

FIG. 6 is a flowchart illustrating the present invention method for forming a pseudo-fractal antenna. Although this method is depicted as a sequence of numbered steps for clarity, no order should be inferred from the numbering unless explicitly stated. It should be understood that some of these steps may be skipped, performed in parallel, or performed without the requirement of maintaining a strict order of sequence. The methods start at Step 600. Step 602 forms a pseudo-fractal geometry conductive section. Step 604, using the pseudo-fractal geometry conductive section, forms a radiator having an effective electrical length. Step 606 electro-magnetically communicates at an operating frequency responsive to the effective electrical length of the radiator.

In some aspects of the method, forming a pseudo-fractal geometry conductive section in Step 602 includes substeps. Step 602*a* forms a fractal geometry conductive section. In some aspects, the fractal geometry conductive section is a second order iteration Koch curve. Step 602*b* forms a non-fractal geometry conductive section. Then, forming a radiator having an effective electrical length in Step 604 includes creating an effective electrical length responsive to the combination of the fractal and non-fractal conductive sections.

Forming a radiator in Step 604 includes forming an antenna that is either a monopole or dipole antenna. In some aspects, Step 604 includes the radiator having an effective electrical length of either a quarter-wavelength (typically with a dipole) or a half-wavelength (typically with a monopole) of the antenna operating frequency. In one aspect of the method, Step 604 includes forming an effective electrical length with respect to an operating frequency of approximately 1575 megahertz (MHz).

In some aspects the method comprises further steps. When the antenna is a monopole antenna, Step 605*a* forms a counterpoise. Step 605*b* forms a dielectric interposed between the counterpoise and the radiator.

In other aspects, when the antenna is a dipole antenna, Step 605*a* forms a counterpoise using a fractal geometry conductive section and non-fractal geometry conductive section. The counterpoise has an effective electrical length responsive to the combination of the fractal and non-fractal conductive sections. Then, Step 605*b* forms a dielectric interposed between the counterpoise and the radiator. In other aspects, Step 605*c* interfaces a transmission line to the antenna, and Step 605*d* creates a 180 degree phase shift at the operating frequency between the radiator and the counterpoise.

A pseudo-fractal antenna system and method have been described above. Specific examples have been given of monopole and dipole antenna types, but it should be understood that the present invention is not limited to a particular antenna design. Examples have also been given of a Koch curve fractal geometry section, however, the present invention is not limited to any particular fractal generator, or any particular order of iteration. Other variations and embodiments of the invention will occur to those skilled in the art.

I claim:

1. A pseudo-fractal antenna comprising:

a transmission line interface;

a dielectric; and a radiator proximate to the dielectric having an effective electrical length formed in a first pseudo-fractal Geometry, the radiator including at least one section formed in a first fractal geometry and at least one section formed in a first non-fractal geometry, the at least one radiator non-fractal geometry section formed further from the transmission line interface than the at least one radiator fractal geometry section.

2. The antenna of claim 1 wherein the radiator has an effective electrical length selected from the group including a half-wavelength and a quarter-wavelength of the antenna operating frequency.

3. The antenna of claim 2, wherein the antenna operating frequency selected from the group including approximately 1575 megahertz (MHz), approximately 850 MHz, and approximately 1920 MHz.

4. The antenna of claim 2 wherein the antenna is selected from the group including monopole and dipole antennas.

5. The antenna of claim 4 wherein the antenna is a monopole antenna; and, the antenna further comprising:

a counterpoise; and, wherein the dielectric is interposed between the counterpoise and the radiator.

6. The antenna of claim 5 wherein the radiator fractal geometry section is formed in a Koch curve.

7. The antenna of claim 4 where the antenna is a dipole antenna; and, the antenna further including:

a counterpoise having an effective electrical length.

8. The antenna of claim 7 wherein the counterpoise has an effective electrical length formed in a second pseudo-fractal geometry.

9. The antenna of claim 8 wherein the counterpoise includes at least one section formed in a second fractal geometry.

10. The antenna of claim 9 wherein the radiator fractal geometry section is formed in a Koch curve; and, wherein the counterpoise fractal geometry section is formed in a Koch curve.

11. The antenna of claim 7 wherein the counterpoise has an effective electrical length formed in a second non-fractal geometry.

12. The antenna of claim 11 wherein the dielectric is a dielectric layer;

wherein the radiator is a conductive line overlying the dielectric layer; and, wherein the counterpoise is a conductive line overlying the dielectric layer.

13. The antenna of claim 12 further comprising:

a balun antenna feed having a transmission line interface, a lead port connected to the radiator, and a lag port, 180 degrees out of phase at the antenna operating frequency with the lead port, connected to the counterpoise.

14. The antenna of claim 1 wherein the radiator is a conductor embedded in the dielectric.

15. The antenna of claim 1 wherein the dielectric is a dielectric layer; and, wherein the radiator is a conductive line overlying the dielectric layer.

16. The antenna of claim 1 further comprising:

a transmission line interface; and wherein the at least one radiator non-fractal geometry section is formed closer to the transmission line interface than the at least one radiator fractal geometry section.

17. The antenna of claim 1 wherein the radiator pseudo-fractal geometry includes a Koch curve.

18. The antenna of claim 17 wherein the radiator pseudo-fractal geometry includes a second order iteration Koch curve.

19. A wireless communications device system comprising:

a wireless communication device receiver; and a pseudo-fractal antenna including: a dielectric, a transmission line interface, and a radiator proximate to the dielectric having an effective electrical length formed in a first pseudo-fractal geometry, the radiator including at least one section formed in a first fractal geometry and at least one section formed in a first non-fractal geometry, and the at least one radiator non-fractal geometry section is formed further from the transmission line interface than the fractal geometry section.

20. The system of claim 19 wherein the radiator has an effective electrical length selected from the group including a half-wavelength and a quarter-wavelength of the antenna operating frequency.

21. The system of claim 20 wherein the antenna operating frequency is approximately 1575 megahertz (MHz).

22. The system of claim 20 wherein the antenna is selected from the group including monopole and dipole antennas.

23. The system of claim 22 wherein the antenna is a monopole antenna; and, the antenna further comprising:

a counterpoise; and, wherein the dielectric is interposed between the counterpoise and the radiator.

24. The system of claim 23 wherein the at least one radiator fractal geometry section is formed in a Koch curve.

25. The system of claim 22 where the antenna is a dipole antenna; and, the antenna further including: a counterpoise having an effective electrical length.

26. The system of claim 25 wherein the counterpoise has an effective electrical length formed in a second pseudo-fractal geometry.

27. The system of claim 26 wherein the counterpoise includes at least one section formed in a second fractal geometry.

28. The system of claim 27 wherein the at least one radiator fractal geometry section is formed in a Koch curve; and wherein the at least one counterpoise fractal geometry section is formed in a Koch curve.

29. The system of claim 25 wherein the counterpoise has an effective electrical length formed in a second non-fractal geometry.

30. The antenna of claim 29 wherein the dielectric is a dielectric layer;

wherein the radiator is a conductive line overlying the dielectric layer; and, wherein the counterpoise is a conductive line overlying the dielectric layer.

31. The system of claim 30 further comprising:

a balun antenna feed having a transmission line interface, a lead port connected to the radiator, and a lag port, 180 degrees out of phase at the antenna operating frequency with the lead port, connected to the counterpoise.

32. The system of claim 19 wherein the radiator is a conductor embedded in the dielectric.

33. The system of claim 19 wherein the dielectric is a dielectric layer; and wherein the radiator is a conductive line overlying the dielectric layer.

34. The system of claim 19 wherein the wireless communications device receiver is a global positioning satellite (GPS) receiver having a port connected to the transmission line interface.

35. The system of claim 19 wherein the wireless communications device receiver is a telephone transceiver having a port connected to the transmission line interface.

36. The system of claim 19 wherein the at least one radiator non-fractal geometry section is formed closer to the transmission line interface than the at least one radiator fractal geometry section.

37. The system of claim 19 wherein the radiator pseudo-fractal geometry includes a Koch curve.

38. The system of claim 37 wherein the radiator pseudo-fractal geometry includes a second order iteration Koch curve.

39. A pseudo-fractal dipole printed line antenna comprising:

a balun antenna feed having a transmission line interface, a lead port, and a lag port 180 degrees out of phase at the antenna operating frequency with the lead port;

a dielectric layer;

a radiator formed on the dielectric layer in a pseudo-fractal pattern and connected to the balun lead port; and, a counterpoise formed on the dielectric layer in a pseudo-fractal pattern and connected to the balun lag port.

40. The pseudo-fractal antenna of claim 39 wherein the radiator includes a plurality of line sections with a least one line section formed in a fractal geometry; and, wherein the counterpoise includes a plurality of line sections with a least one line section formed in a fractal geometry.

41. The pseudo-fractal antenna of claim 40 wherein the radiator fractal geometry line section is formed in a Koch curve; and, wherein the counterpoise fractal geometry line section is formed in a Koch curve.

42. The pseudo-fractal antenna of claim 41 wherein the radiator has an effective electrical length of a quarter-wavelength of the antenna operating frequency; and, wherein the counterpoise has an effective electrical length of a quarter-wavelength of the antenna operating frequency.

43. The pseudo-fractal antenna of claim 42 in which the antenna operating frequency is approximately 1.575 gigahertz (GHz).

44. The pseudo-fractal antenna of claim 41 wherein the dielectric layer is FR4 material having a thickness of 15 mils.

45. The pseudo-fractal antenna of claim 44 wherein the radiator is formed from half-ounce copper; and, wherein the counterpoise is formed from half-ounce copper.

46. The pseudo-fractal antenna of claim 45 wherein the radiator is formed in lines having a width of approximately 30 mils; and, wherein the counterpoise is formed in lines having a width of approximately 30 mils.

47. A method for forming a pseudo-fractal dipole antenna, the method comprising:

forming a first pseudo-fractal geometry conductive section comprising a first fractal geometry conductive section and a first non-fractal geometry conductive section;

forming a radiator from the first pseudo-fractal geometry conductive section, the radiator having an effective electrical length responsive to the combination of the first fractal and the first non-fractal conductive sections, the radiator effective electrical length selected from the group including a quarter-wavelength and a half-wavelength of the antenna operating frequency;

forming a counterpoise using a second fractal geometry conductive section and a second non-fractal geometry conductive section, the counterpoise having an effective electrical length responsive to the combination of the counterpoise fractal and non-fractal conductive sections; and forming a dielectric interposed between the counterpoise and the radiator.

48. The method of claim 47 further comprising:

electro-magnetically communicating at an operating frequency responsive to the effective electrical length of the radiator.

49. The method of claim 47 wherein forming a radiator includes the radiator having an effective electrical length with respect to an operating frequency of approximately 1575 (MHz).

50. The method of claim 47 wherein the first fractal geometry conductive section includes a Koch curve.

51. The method of claim 47 further comprising:

interfacing a transmission line to the antenna; and, creating a 180 degree phase shift at the operating frequency between the radiator and the counterpoise.

52. A method for forming a pseudo-fractal antenna, the method comprising:

forming a transmission line interface forming a pseudo-fractal geometry conductive section comprising a fractal geometry conductive section and a non-fractal geometry conductive section;

forming a radiator from the pseudo-fractal geometry conductive section, wherein the non-fractal geometry section is formed further from the transmission line interface than the fractal geometry section; and locating the antenna proximate a dielectric, wherein the antenna has an effective electrical length.

* * * * *